US011485039B1

(12) United States Patent
Krugler

(10) Patent No.: US 11,485,039 B1
(45) Date of Patent: Nov. 1, 2022

(54) STOP ATTACHABLE TO CHAINSAW BAR

(71) Applicant: Arthur H. Krugler, Grass Valley, CA (US)

(72) Inventor: Arthur H. Krugler, Grass Valley, CA (US)

( * ) Notice: Subject to any disclaimer, the term of this patent is extended or adjusted under 35 U.S.C. 154(b) by 0 days.

(21) Appl. No.: 17/462,492

(22) Filed: Aug. 31, 2021

(51) Int. Cl.
*B27B 17/00* (2006.01)
*B27B 17/02* (2006.01)

(52) U.S. Cl.
CPC ..... *B27B 17/0083* (2013.01); *B27B 17/02* (2013.01)

(58) Field of Classification Search
CPC ..... B27B 17/02; B27B 17/008; B27B 17/00
USPC ..... 30/383
See application file for complete search history.

(56) References Cited

U.S. PATENT DOCUMENTS 2,930,416 A * 3/1960 Granberg ..... B27B 17/0083 30/371
4,142,292 A 3/1979 Ulrich
5,511,315 A * 4/1996 Raya ..... B27B 17/0083 30/382
5,669,145 A * 9/1997 Skripsky ..... B27B 17/0083 30/382
5,878,499 A * 3/1999 King ..... B27B 17/0083 30/382
2009/0133269 A1* 5/2009 Hanaway ..... B27B 17/0083 30/383
2015/0298344 A1* 10/2015 Hallendorff ..... F16N 19/00 30/123.4

OTHER PUBLICATIONS

Firepenny Firefighter Equipment; Tempest VentMaster Ventilation Fire Chain Saw; www.firepenny.com.

* cited by examiner

*Primary Examiner* — Nhat Chieu Q Do
(74) *Attorney, Agent, or Firm* — Heisler & Associates

(57) ABSTRACT

A stop has an elongate form between a base and a tip, with the base configured to be attachable to a chainsaw bar closer to a free end of the bar then to a housing of the chainsaw to which the bar is mounted. The stop extends below a lower edge of the bar. Bolts or other fasteners pass through holes in the stop and through holes in the bar for attachment. Positioning of the stop separates a tip space from a main space where chain teeth can cut wooden material. Smaller branches can conveniently be cut in the tip space while larger wooden material can be cut in the main space. The stop is configured to include clearance for the chain to pass thereby, such as by including standoffs in the stop adjacent to holes at the base, or by providing a clearance groove or clearance bend.

8 Claims, 3 Drawing Sheets

STOP ATTACHABLE TO CHAINSAW BAR

FIELD OF THE INVENTION

The following invention relates to chainsaws for providing a handheld tool to cut wooden material. More particularly, this invention relates to stops and other accessories for chainsaws which attach to a bar of a chainsaw to enhance chainsaw utility in cutting both small and large material.

BACKGROUND OF THE INVENTION

Origin of the chainsaw is uncertain. A saw of the chain type was invented and used by two surgeons in Scotland, in 1780 to saw through bones during surgery. There is a report that a German surgeon, Bernhard Heine, "invented" a chainsaw in 1830 for similar use.

It was adapted to cutting trees and in the 1900's a two man chainsaw could be purchased at Montgomery Ward & Company. It had a heavy 4 stroke gasoline engine, a 3 foot blade. Operation required two strong men, one using two handles to carry the motor and a second man using a handle beyond the blade. The engine remained vertical while the blade could be tilted to cut horizontally during felling a tree and then tilted vertically to cut logs to length. It obviously could not be used above the ground.

Development of two cycle engines that could operate in any position resulted in the modern chainsaw after 1950. The nuisance of having to add lubricating oil to the gasoline for the two stroke engine was far outweighed by the lighter and more versatile engine. Chains must be constantly lubricated to avoid early wear and self lubricators were also developed using oil from a small reservoir.

Of major importance is the role chainsaws play in preventing and controlling forest fires. Before fire season fire-free zones are created along evacuation roads, around homes and other structures. Chainsaws are vital to cutting down nearby trees and brush to clear the area of dry combustible fuels. "Firebreaks" are also created to remove fuel from a lane through forest areas. Again, chainsaws are the most important tool. Bulldozers are used but are slow, clumsy and subject to roll-over on slopes. Control of forest fires is largely accomplished by using chainsaws to create a fuel-free lane close to the fire and setting backfires to burn away combustible brush and trees between the lane and the fire. Having a chainsaw that cuts brush and tree limbs much faster would be a valuable asset.

It is known in the prior art to provide attachments and/or modifications to chainsaws to make them useful in trimming bushes and hedges. With such devices, a series of stationary stops are mounted to the blade/bar of the chainsaw with tips of the multiple stops extending below the chain on the lower edge of the blade/bar. The stops limit the size of material that can be cut down to about four inches or less. While useful for smaller diameter material, such attachments prevent use of the chainsaw on larger material.

SUMMARY OF THE INVENTION

With this invention, a chainsaw is provided which has been modified by a stop. The chainsaw can be any of a variety of chainsaws which do not need modification according to this invention, other than forming of holes near a tip of the bar for attachment of the stop to the bar.

The stop is an elongate structure formed of rigid material such as steel or high strength plastic. The elongate structure extends from the base to a tip. The base includes holes through which fasteners can pass, and which also can pass through holes in the bar for mounting of the stop to the bar. The structure of the stop can have different cross-sections in different forms, with one embodiment configuring the structure with a planar web bounded at forward and rearward edges with parallel flanges.

While the stop could have a variety of different lengths, one appropriate length is to cause the tip of the stop to extend down from the lower edge of the bar a distance similar to a distance from a mounting location on the bar to a free end of the bar. For instance, if the stop is mounted to the bar 5 inches from the free end of the bar, the tip can extend about 5 inches from the lower edge of the bar. With such a sizing, branches or other wooden material having a diameter or other size of up to about 5 inches can be cut by placement of such items adjacent to the lower edge of the chainsaw blade and forward of the stop.

Importantly, larger material can still be cut by the chainsaw by utilizing a main space between the stop and the housing of the chainsaw which is left open and usable by the placement of the stop closer to the free end of the bar than to the housing. Also, in one embodiment the stop has a linear form but is angled forward somewhat so that an angle between the centerline of the bar and a longest dimension of the stop is less than 90°. The tip of the stop not only acts as a reference surface to allow cutting of smaller material adjacent to the free end of the bar, but also helps to keep the free end of the bar from coming into contact with the ground and dulling the teeth on the chain. The tip of the stop can also act as a rest when the saw is not in use, to keep the chain off of the ground when not in use, and off of the ground when starting the saw.

A clearance space is provided for the teeth of the chain to safely pass the stop when the chainsaw is in operation. In one embodiment, such clearance space is provided by including standoffs formed into the planar web surrounding the holes at the base of the stop. A height of these standoffs causes the planar web to be spaced away from a mounting plane (aligned with a surface of the bar), which also acts to provide clearance for teeth of the chain to pass the stop. As an alternative or in addition to the standoffs, washers can be provided between the stop and the bar surface, surrounding bolts or other fasteners passing through holes in the stop and bar for mounting of the stop to the bar. Other options including a clearance groove formed in the stop to provide appropriate clearance for chain teeth, or including a bend in the stop so that a clearance space is provided at a location where the chain teeth pass the stop.

OBJECTS OF THE INVENTION

Accordingly, a primary object of the present invention is to provide a dual service saw and/or a method for modifying a chainsaw to become a dual service saw, combining the utility of a long bar saw and a short bar saw together in a single chainsaw.

Another object of the present invention is to provide a chainsaw equipped with an additional stop to allow the chainsaw to be used as a normal saw in felling trees or cutting logs which fit within a main space of the saw, while also facilitating cutting of smaller branches forward of the stop near a free end of the bar.

Another object of the present invention is to provide a stop attachable to a chainsaw to reduce risk that a chain will be damaged or thrown off of the bar by cutting small branches.

Another object of the present invention is to reduce risk of striking rocks with a tip of a chain by allowing small branches to be more easily cut at locations further from the ground without flexing of the branches inhibiting the cutting of the branches.

Another object of the present invention is to provide a chainsaw which can more rapidly cut a wide variety of sizes of wooden material by locating a stop on the saw to provide two portions of the saw optimized for cutting of different size material.

Another object of the present invention is to provide a chainsaw optimized for fire fighting in that the chainsaw can rapidly cut paths through brush for establishing a firebreak, with the single saw both cutting small branches and larger wooden material with different portions of the same chainsaw.

Another object of the present invention is to provide a stop attachable to a chainsaw (and associated method) which can be attached to a chainsaw with a minimum of modification to the chainsaw and which can allow the chainsaw to more readily cut small branches and other small wooden material.

Other further objects of the present invention will become apparent from a careful reading of the included drawing figures, the claims and detailed description of the invention.

DESCRIPTION OF THE PREFERRED EMBODIMENT

Figure 1:
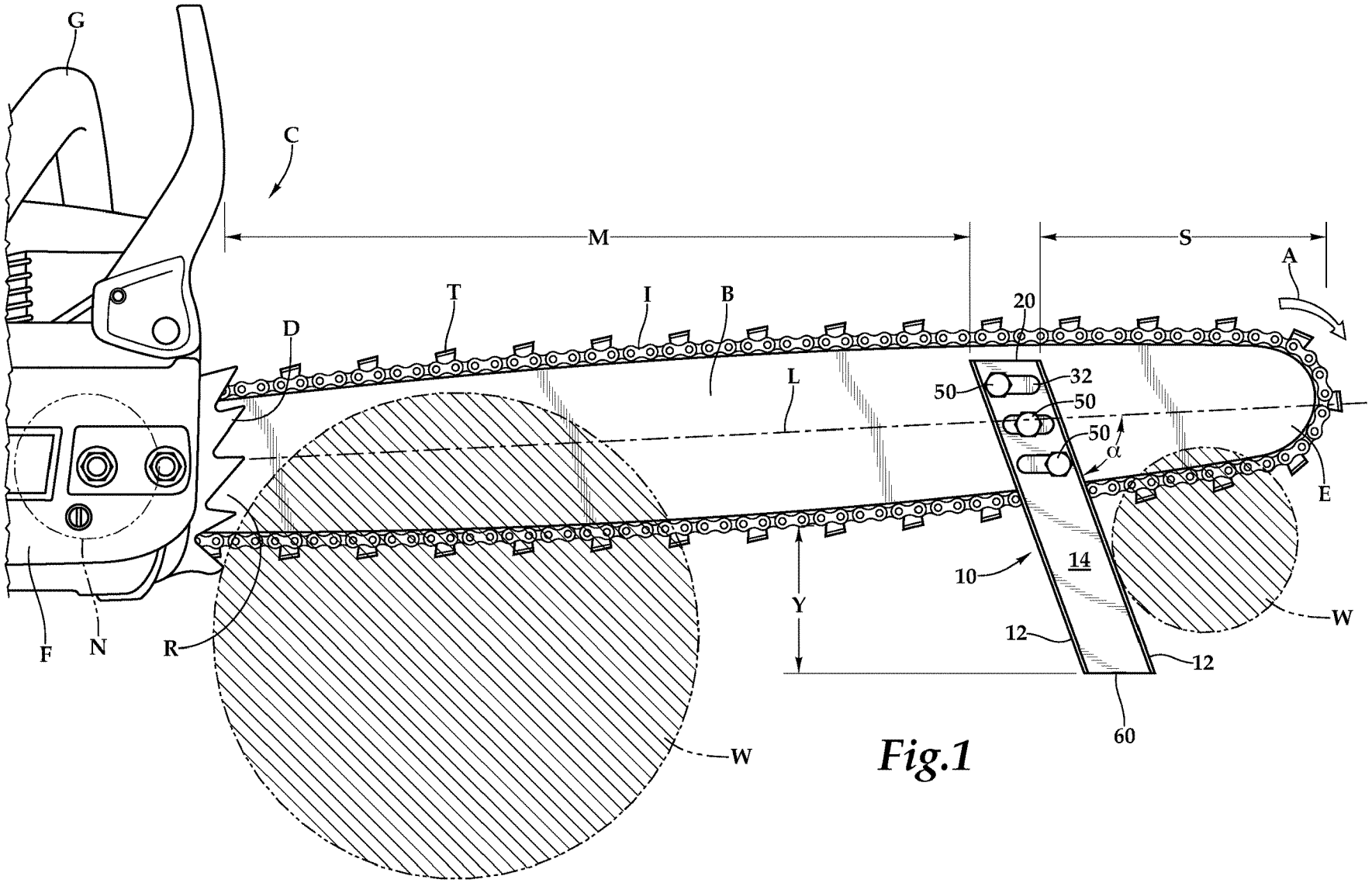
FIG. 1 is a side elevation view of a chainsaw with a stop according to one embodiment of this invention attached to a bar thereof, and showing a large wooden member and a smaller wooden member adjacent to the chainsaw to illustrate function of the chainsaw with the stop in place.

Referring to the drawings, wherein like reference numerals represent like parts throughout the various drawing figures, reference numeral 10 is directed to a stop for a chainsaw C (FIG. 1). This stop 10 is configured to attach to a blade/bar B (FIG. 2) of a chainsaw C so that the chainsaw C can be configured to more effectively cut branches and other small material W, while maintaining the chainsaw's ability to also cut larger diameter material W.

Figure 2:
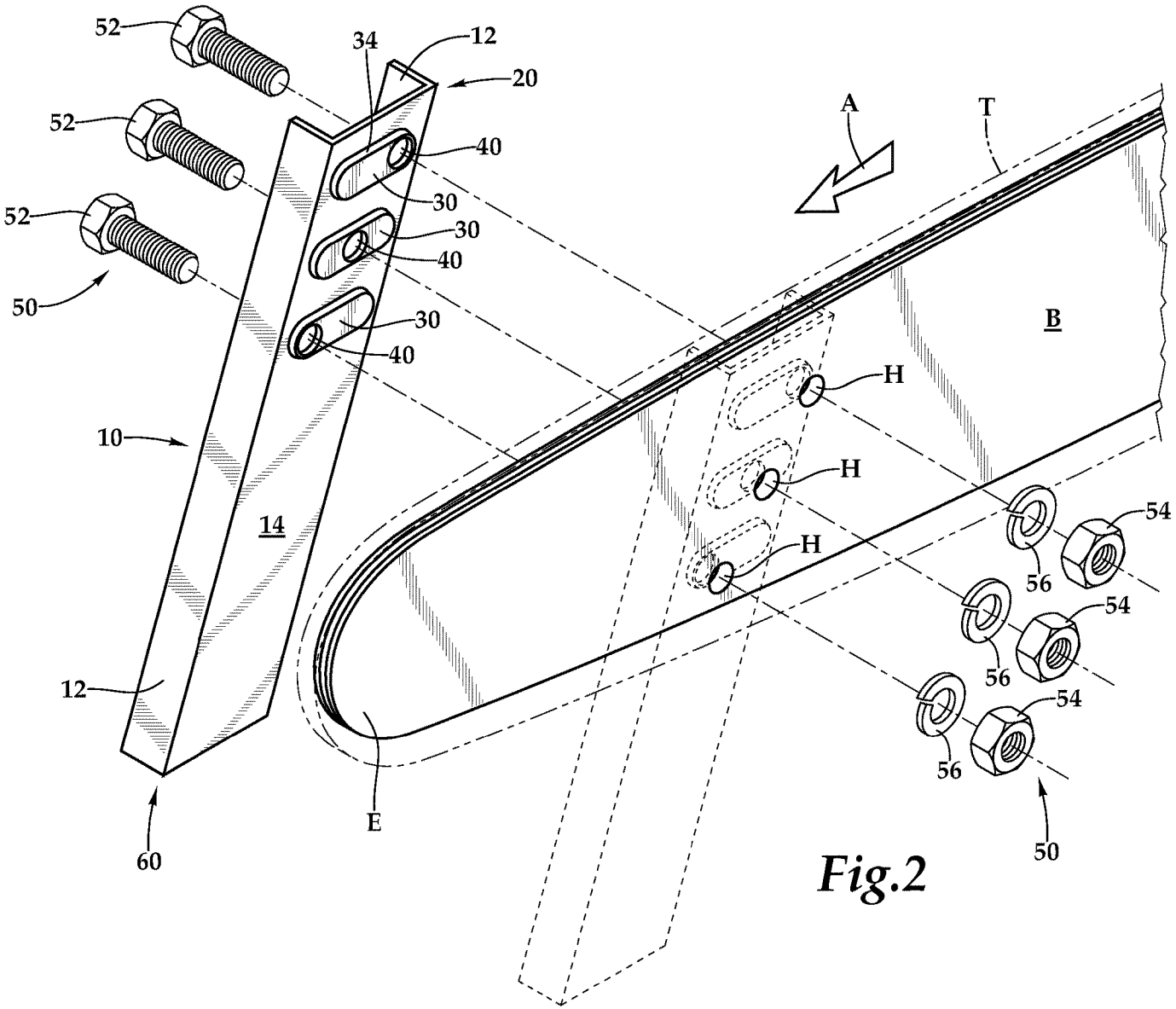
FIG. 2 is a perspective view of that which is shown in FIG. 1, illustrating how the stop is attached to the bar of the chainsaw.
Figures 3, 4, 5, 6, 7, 8, 9, 10:
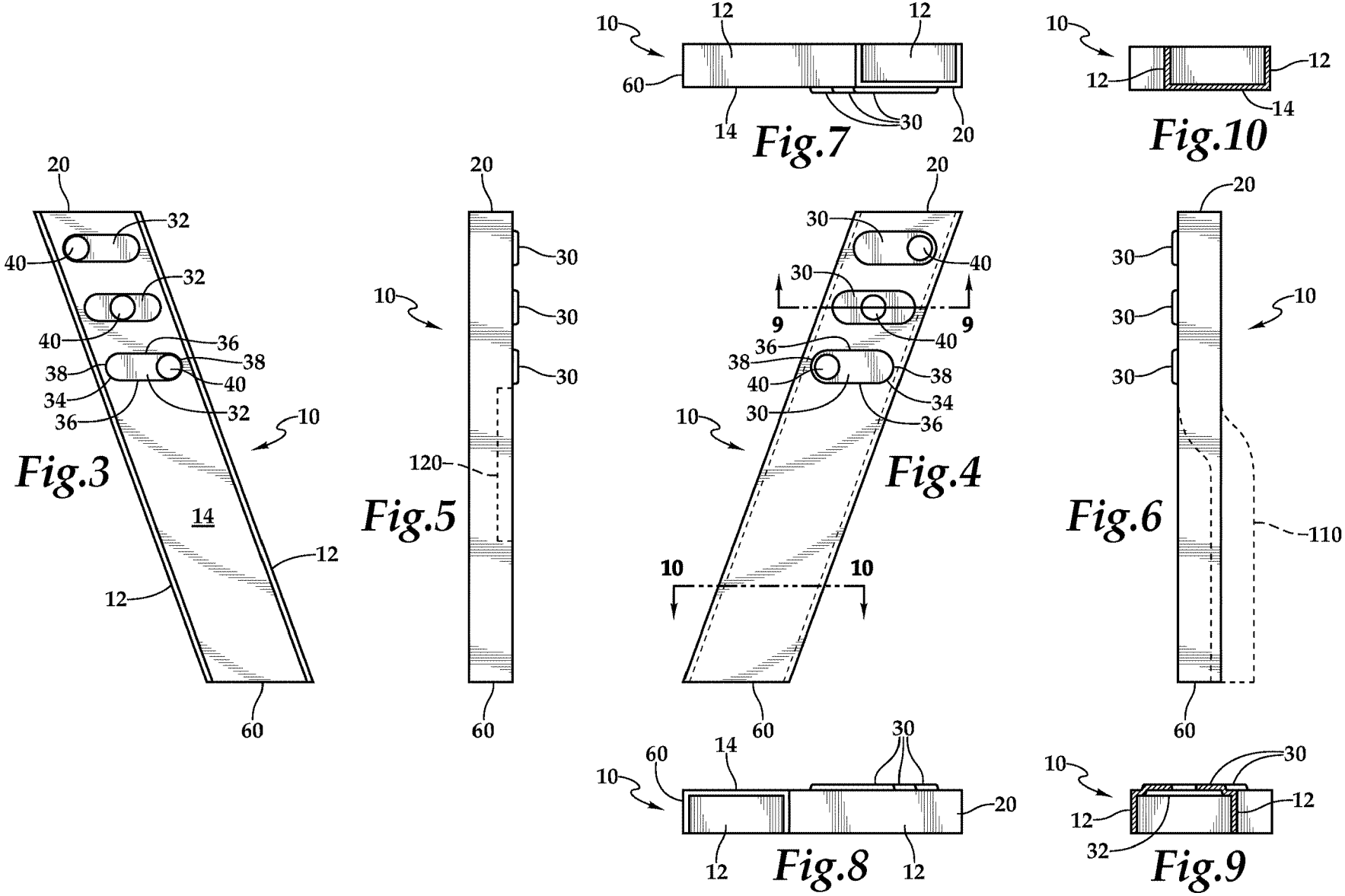
FIG. 3 is a left side elevation view of the stop of FIG. 1.
FIG. 4 is a right side elevation view of that which is shown in FIG. 3.
FIG. 5 is a front elevation view of that which is shown in FIG. 3, and with broken lines illustrating an alternative embodiment clearance groove.
FIG. 6 is a rear elevation view of that which is shown in FIG. 3, and with broken lines illustrating an alternative embodiment bent stop.
FIG. 7 is a top plan view of that which is shown in FIG. 4.
FIG. 8 is a bottom plan view of that which is shown in FIG. 4.
FIG. 9 is a top plan section view taken along line 9-9 of FIG. 4.
FIG. 10 is a top plan sectional view taken along line 10-10 of FIG. 4.

In essence, and with particular reference to FIGS. 1 and 2, basic details of the stop 10 are described, according to one example embodiment. The stop 10 is an elongated rigid structure extending from a base end 20 to a tip 60. Standoffs 30 preferably surround holes 40 in the base end 20 of the stop 10. Fasteners 50 interact with the holes 40 (and holes H) to mount the base end 20 of the stop 10 to the blade/bar B of the chainsaw C. Strategic positioning of the stop 10 relative to the bar B causes a tip space S between the stop 10 and a free end E of the bar B to be smaller than a main space M between the stop 10 and a root R of the bar B opposite of the free end E, and adjacent to a housing of the chainsaw C. The standoffs 30 provide a clearance space for passage of teeth T of the chain I carried by the bar B to avoid striking the stop 10 as the chain I moves along arrow A. Alternatively or in addition, a clearance groove 120 (FIG. 5) can be provided to keep the stop 10 from contacting the teeth T of the chain I, or the stop 10 can be configured with a bend 110 (FIG. 6) to keep the stop 10 from contacting the teeth T of the chain I.

More specifically, and with particular reference to FIGS. 3-10, details of the stop 10 are described according to one example embodiment. This stop 10 is a rigid elongate structure having a greater length than its width or thickness. The stop 10 is formed of rigid material, such as steel or other metal or high strength polymeric hydrocarbon material or similar material. Most preferably, the stop 10 is formed by extrusion and/or bending/pressing of a planar sheet of steel into the finished form desired for the stop 10.

A general form of the stop 10 includes a planar web 14 bounded on forward and rearward edges by two parallel flanges 12. The flanges 12 are preferably oriented perpendicular to the web 14 so that the stop 10 has the general cross-sectional form of C-channel. The flanges 12 extend in a direction away from a mounting plane, which mounting plane defines a surface of the bar B to which the stop 10 attaches. In this way, the flanges 12 add rigidity and strength to the stop 10, without the flanges 12 risking coming into contact with the teeth T of the chain I as the chain I moves (along arrow A of FIG. 1) upon the edges of the bar B. In other embodiments, the flanges 12 could be eliminated or have other configurations.

The base end 20 of the stop 10 define a portion of the stop 10 which attaches to the bar B of the chainsaw C. In this example embodiment, three holes 40 pass through the stop 10 near the base end 20. Other numbers of holes could alternatively be provided. Holes H are also formed in the bar B (FIG. 2) which can be aligned with the holes 40 in the stop 10. Fasteners 50, such as bolts 52, nuts 54 and washers 56 (FIG. 2) can work with the holes 40 and holes H to secure the stop 10 to the bar B.

While three holes 40 are shown in this example embodiment, two holes 40 could alternatively be utilized. It is also conceivable that a single hole could be provided, so long as some structure is provided to prevent rotation of the stop 10 relative to the bar B. Larger number of holes H could also alternatively be provided. The holes 40 are shown with a particular pattern relative to each other. Such an arrangement of holes 40 allows for sufficient space so the holes 40 do not weaken the stop 10 or the corresponding holes H in the bar B do not appreciably weaken the bar B, even if the stop 10 is not attached. The stop 10 could be modified to have different shapes and orientations to allow for various different numbers of holes to be positioned at different locations in the bar B and within such a modified stop.

The holes 40 preferably are located within standoffs 30. These standoffs 30 are in this embodiment formed by pressing elongate wells 32 into a surface of the web 14 between the flanges 12, to cause the standoffs 30 to protrude from a surface of the web 14 adjacent to the mounting plane. The wells 32 preferably are oblong in form with a stepped perimeter 34 defining a depth of the wells 32 and a height of the standoffs 30. The wells 32 have parallel sides 36 opposite each other which sides 36 are generally horizontal, and which space apart ends 38 at a forward and rearward extent of each of the wells 32.

The holes 40 reside within these wells 32 and preferably a space between the sides 36 of the wells 32 is similar to a diameter of the holes 40. In this particular embodiment, the wells 32 are centrally aligned with an elongate central axis of the stop 10, but with the holes 40 having differing positions within each of the wells 32, with a lowermost hole 40 being located most forward, and with an uppermost well 32 having its corresponding hole 40 located most rearward, and with a hole 40 in a central well 32 located at a center point thereof.

As an alternative, or in addition, washers 56 (FIG. 2) could be provided adjacent to the holes 40. Such washers 56 could be lock washers or plain washers, or a combination of both. Washers 56 can help to keep bolt 52 and nut 54 pairs from becoming loosened when encountering vibration. Furthermore, the washers 56 help to increase the spacing from the web 14 to the mounting plane, which clearance space helps to keep the chain teeth T from impacting the stop 10.

The stop 10 is preferably configured so that the tip 60 is truncated along a horizontal line. However, the stop 10 is preferably attached to the bar B (FIGS. 1 and 2) so that it is angled forward from vertical somewhat. In the embodiment depicted, an angle $\alpha$ of 70° is provided between a central axis of the stop 10 and a centerline L of the bar B. This angle $\alpha$ could be between 90° and 45° and still have some effectiveness. An uppermost end of the base end 20 is also preferably cut horizontally so that the overall stop 10 has the form of a parallelogram with opposite corners measuring either 70° or 110°. Other angular measurements could alternatively be provided. In one embodiment, the tip 60 tapers in width between the flanges 12 or other forward and rearward surfaces as it extends down to a lowermost portion thereof.

The stop 10 is positioned strategically so that a tip space S and a main space M are defined (FIG. 1). The tip space S is a portion of the lower edge of the bar B between the stop 10 and the free end E of the bar B. The main space M is a distance between the stop 10 and the root R of the bar B adjacent to the dogs D (if any) on the housing of the chainsaw C. The tip space S is preferably less than half of a size of the main space M. In many embodiments, the tip space S is less than a third of a size of the main space M. Most preferably, if the bar B is of a greater and greater length, the tip space S is held relatively constant at approximately 4 to 5 inches, while the main space S can be allowed to increase to a greater and greater size. Longer bars B can allow for larger and larger material to be cut. Typically material having a diameter of more than 4 inches is not prone to much movement when encountering forces from the chainsaw C acting thereon. Thus, it is generally most preferable to keep the tip space less than 4 or 5 inches to maintain the ability of chainsaws C of all sizes to cut smaller diameter material which is prone to bending and movement during cutting procedures.

The length of the stop 10 defines a height Y between the tip 60 of the stop 10 and the lower edge of the bar B. Most preferably, this height Y is similar to the tip space S, such as about 4 to 5 inches. As an alternative, the tip space S and/or the height Y could be a lesser amount, such as 3 inches or even as little as 2 inches and still maintain at least some limited effectiveness. Generally, the height Y is between half and double the tip space S.

In use and operation, and with particular reference to FIG. 1, details of the use of the chainsaw C with associated stop 10 is described, according to this illustrated embodiment. First, a bar B is selected which has holes H therein, or holes are formed therein as shown (FIG. 2). The stop 10 can then be mounted to the bar B, as illustrated in FIG. 2. As an alternative, a bar B with the stop 10 already attached thereto can be used to replace an existing bar B of a chainsaw C. The chainsaw C will then be configured as shown in FIG. 1.

A user who wishes to rapidly cut both small and large branches starts the chainsaw C and approaches the area to be cut. Using judgment as to which material is best cut first, the user selects a branch, limb or trunk to be cut. If the material W to be cut is smaller than about 4 inches in diameter, the user manipulates at least one grip G on the housing F and orients the chainsaw C relative to the material W to be cut so the material W is engaged by the lower edge of the blade B and the teeth T of the chain forward of the stop 10. Such material W is pinched between a leading portion of the stop 10 and the chain I. The chain I then cuts through the material while the material is supported by the stop 10. The housing F supports a motor N of the chainsaw C that is configured to drive the chain I over the bar B.

If the material W to be cut is larger than about 4 inches, the chainsaw C is oriented so that the material W to be cut engages the chain teeth T between the stop 10 and the housing of the chainsaw C. Typically, the dogs D will be allowed to engage the material W being cut, so that additional leverage can be exerted by the user and the larger material W is allowed to be cut by the chain teeth T. This process is then repeated for new material to be cut. The user can move rapidly through large quantities of material W of a wide variety of sizes, which can be useful when cutting paths rapidly through dense brush, such as when cutting firebreak when fighting wildfire or taking preventative measures in advance of wildfire.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A chainsaw comprising:

an elongate bar extending from a first end to a second free end;

a chain with cutting teeth carried over first and second edges of said bar and routed around said second free end of said bar;

a housing supporting a motor of the chainsaw, the motor configured to drive said chain over said bar, and with said housing having at least one grip for handling the chainsaw;

a stop fixed to said bar at a base of said stop;

said stop extending beyond said second edge of said bar to a tip, said tip opposite said base;

said stop spaced toward said first end from said second free end of said bar by a tip space;

said stop spaced from said housing by a main space greater than said tip space, said main space fully open to allow wooden members having a size of up to a size similar to said main space to access said chain beyond said second edge of said bar and between said stop and said housing;

wherein said bar includes a plurality of holes passing therethrough, and wherein said stop has an elongate form extending between terminal ends including said base and said tip, said stop including holes therein which are closer to said base than to said tip, and wherein fasteners secure said stop to said bar by passing of said fasteners through said holes in said stop and said holes in said bar;

wherein said stop is spaced laterally from said bar to provide clearance for said chain passing adjacent to said stop by standoffs adjacent to said holes in said stop, which the standoffs space said stop away from a mounting plane at which said standoffs terminate, said mounting plane adjacent to a surface of said bar that is adjacent to said stop;

wherein said stop has the elongate form extending between the two terminal ends including the tip at a first end opposite the base at a second end, said stop including three holes passing laterally through said stop at locations on said stop which are each closer to said base than to said tip, said stop having a C-shaped cross-section along a plane perpendicular to a line extending between said two terminal ends, said C-shaped cross-section including a planar web and a pair of flanges extending laterally from edges of said web, said holes of the stop located within said web, said web having an adjacent side closer to said bar than an opposite side of said web, said flanges extending from said opposite side of said web, away from said adjacent side of said web, said holes of the stop each located within the standoffs which the standoffs extend from said adjacent side of said web and toward said bar and cause said adjacent side of said web to be spaced by a clearance amount from said bar while said web remains parallel with said mounting plane and parallel with said bar; and wherein said standoffs include wells pressed into said web and extending into said opposite side of said web and out of said adjacent side of said web, each of said standoffs having a length, longer than a wide of said standoff, extending parallel to a length of said bar.

2. The chainsaw of claim 1 wherein said tip of said stop extends beyond said second edge of said bar by a distance between half and two times said tip space.

3. The chainsaw of claim 1 wherein said tip of said stop extends from said base of said stop in a direction closer to perpendicular to a centerline of said bar than parallel to said centerline of said bar.

4. The chainsaw of claim 3 wherein said tip extends from said base at an angle relative to said centerline of said bar measuring between 90° and 45°.

5. The chainsaw of claim 4 wherein said tip extends from said base at an angle relative to said centerline of said bar of 70°.

6. The chainsaw of claim 1 wherein said main space is greater than two times said tip space.

7. The chainsaw of claim 6 wherein said main space is greater than three times said tip space.

8. The chainsaw of claim 1 wherein said stop has a bend therein, between said base and said tip, with said base and said tip parallel to each other, but with said tip offset relative to said base by a clearance space to keep said chain adjacent to said bar from impacting portions of said stop beyond said bend.

* * * * *